US005311786A

United States Patent [19]

Moribayashi

[11] Patent Number: 5,311,786

[45] Date of Patent: May 17, 1994

[54] COAXIAL STARTER MOTOR

[75] Inventor: Satoshi Moribayashi, Himeji, Japan

[73] Assignee: Mitsubishi Denki Kabushiki Kaisha, Tokyo, Japan

[21] Appl. No.: 67,113

[22] Filed: May 26, 1993

[30] Foreign Application Priority Data

May 29, 1992 [JP] Japan ..... 4-163805

[51] Int. Cl.[5] ..... F02N 11/00

[52] U.S. Cl. ..... 74/7 C; 74/7 E

[58] Field of Search ..... 74/7 R, 7 A, 7 C, 7 E; 192/42, 45, 110 B

[56] References Cited

U.S. PATENT DOCUMENTS

| | | | |
|---|---|---|---|
| 4,800,766 | 1/1989 | Isozumi et al. | 74/7 E |
| 4,907,464 | 3/1990 | Isozumi | 74/7 E X |
| 4,987,786 | 1/1991 | Morishita et al. | 74/7 E X |
| 5,052,235 | 10/1991 | Isozumi | 74/7 E |
| 5,081,874 | 1/1992 | Isozumi | 74/7 A |
| 5,081,875 | 1/1992 | Isozumi et al. | 74/7 R |
| 5,154,089 | 10/1992 | Konishi | 74/7 E |
| 5,154,090 | 10/1992 | Konishi | 74/7 EO |

FOREIGN PATENT DOCUMENTS 2-275063 11/1990 Japan .

*Primary Examiner*—Allan D. Herrmann
*Assistant Examiner*—David W. Laub
*Attorney, Agent, or Firm*—Sughrue, Mion, Zinn, Macpeak and Seas

[57] ABSTRACT

A coaxial type starter motor comprises a d.c. motor comprising a hollow armature rotary shaft and a front bracket connected to a yoke, an overrunning clutch disposed in the front bracket to transmit a rotational force from the rotary shaft, an output shaft having a rear end portion which is extended into the hollow rotary shaft and is supported by a bearing so as to be slidable forwardly and backwardly, the output shaft having a helical spline connection to a clutch inner in the overrunning clutch to obtain the transmission of a rotational force, and a pinion mounted on the front end portion of the output shaft so as to come to interlocking with the ring gear of an engine when the output shaft is forwardly moved, wherein a clutch outer in the overrunning clutch has an enlarged diameter portion for supporting a roller at its rear end side, a boss portion of a reduced diameter at its front end side, in which the outer periphery of the boss portion is supported by the front bracket by means of a bearing, and the clutch inner is supported by the inner periphery of the boss portion of the clutch outer by means of a bearing.

1 Claim, 2 Drawing Sheets

COAXIAL STARTER MOTOR

BACKGROUND OF THE INVENTION

1. Field of the Invention

The present invention relates to a coaxial type starter motor which is connectable to an electromagnetic switch at its rear portion and is provided with an output shaft with a pinion at the front end portion of the output shaft.

2. Discussion of Background

FIG. 2 is a front view partly cross-sectioned in the longitudinal direction of a conventional starter motor disclosed in, for instance, Japanese Unexamined Patent Publication No. 149349/1991 wherein the upper half portion of the output shaft of the starter motor indicates a retracted, returned state and the lower half portion indicates an advanced state. In FIG. 2, numeral 1 designates a d.c. motor having an armature in which a hollow rotary shaft 2 is disposed. The front portion of the rotary shaft 2 is supported by a bearing supporting portion 17*a* formed in a yoke 17 by means of a bearing 18. Numeral 4 designates an output shaft the rear end of which is extended into the rotary shaft 2 and is supported by a bearing 14. The front end of the output shaft 4 is connected with a pinion 3 through a spline connection, and a stopper 12 is disposed at the front end of the pinion 3. Numeral 8 designates a front bracket of the d.c. motor 1. A planetary reduction gear device 7 comprises a sun gear formed at the front end of the rotary shaft 2, an internal gear wheel 7*b* fixed inside the front bracket 8, and a plurality of planetary gears 7*d* interlocked with the sun gear 7*a*. Each of the planetary gears 7*d* is supported by a supporting pin 7*c*. The planetary gears 7*d* are also interlocked with the internal gear wheel 7*b* to effect a revolving motion. A carrier 19 is supported by the rotary shaft 2 by means of a bearing 20, and the supporting pins 7*c* are firmly attached to the carrier 19.

An overrunning clutch 9 transmits revolution reduced by the planetary reduction gear device 7 to the output shaft 4 in one direction. The overrunning clutch 9 has a construction as follows. A clutch outer 9*a* is firmly attached to the carrier 19 and a clutch inner 9*b* is fitted to the clutch outer 9*a* by means of rollers 9*c* to transmit a one way revolution force to the output shaft 4. Numeral 21 designates a fitting plate, and numeral 22 designates a cover fixed by caulking to the clutch outer 9*a* and connected to the clutch inner 9*b* in the axial direction. The cover 22 seals grease charged therein. The clutch inner 9*b* is supported by the front bracket 8 by means of a bearing 11.

The output shaft 4 has a helical spline portion 4*a* which is interlocked with a helical spline groove 9*d* formed in the inner circumference of the clutch inner 9*b* to thereby transmit a rotation force.

A cylindrical portion 15 is extended from the rear end of the pinion 3, and the outer periphery of the cylindrical portion 15 is slidably supported by the inner periphery of the clutch inner 9*b*. On the other hand, the inner periphery of the cylindrical portion 15 supports the outer periphery of the front portion of the output shaft 4 so as to be slidable. Numeral 10 designates a return spring to retract the output shaft 4, and numeral 13 designates a shock absorbing spring which pushes the pinion 3 forwardly.

Numeral 16 designates an electromagnetic switch attached to the rear portion of the d.c. motor in a coaxial manner. The electromagnetic switch 16 is provided with a movable rod firmly attached with a movable iron core. The front end of the movable rod pushes a push rod by means of a compression spring. The front end of the push rod faces the rear end of the output shaft 4 by means of a steel ball (each not shown). The electromagnetic switch 16 is so constructed that the movable iron core is attracted to the fixed iron core electromagnetically so that a movable contact supported by the movable rod is brought into contact with a fixed contact, whereby current is fed to the d.c. motor.

In the conventional device described above, when a starter switch is turned on, the output shaft 4 is moved forwardly by the action of the electromagnetic switch 16 through the push rod, and the pinion 3 attached to the output shaft 4 is meshed with the ring gear of the engine. Then, the movable contact is brought into contact with the fixed contact so that the main circuit of the d.c. motor 1 becomes conductive, and the rotary shaft 2 is rotated by the armature. The rotational speed of the rotary shaft 2 is reduced by the planetary reduction gear device 7, and the reduced revolution is transmitted to the output shaft 4 through the overrunning clutch 9, whereby the revolution is transmitted to the engine by means of the pinion 3. When the engine is started and the starter switch is turned off, the output shaft 4 is retracted by means of the return spring 10, and the movable rod, movable iron core and movable contact are retracted and returned by means of the pushing rod.

In the conventional coaxial type starter motor, the axial center of the clutch outer 9*a* is determined by the carrier 19, the rotary shaft 2, the bearing 20, the bearing supporting portion 17*a* and the bearing 18. On the other hand, the axial center of the clutch inner 9*b* is determined by the inner periphery of the front bracket 8 to which the bearing 11 is fitted. The front bracket 8 is fixed to the yoke 17. Since a number of elements are fitted to each other, it is difficult to maintain the clutch outer 9*a* and clutch inner 9*b* in a coaxial manner. Especially, when the engine is an overrunning state, deflection of the axial centers of the clutch outer 9*a* and the clutch inner 9*b* easily takes place. As a result, durability of the overrunning clutch 9 may be reduced.

SUMMARY OF THE INVENTION

It is an object of the present invention to eliminate the above-mentioned problem and to provide a coaxial type starter motor which minimizes deflection in the axial centers of the clutch outer and the clutch inner and which improves durability of the overrunning clutch.

The foregoing and other objects of the present invention have been attained by providing a coaxial type starter motor which comprises a d.c. motor comprising a hollow armature rotary shaft and a front bracket connected to a yoke, an overrunning clutch disposed in the front bracket to transmit a rotational force from the rotary shaft, an output shaft having a rear end portion which is extended into the hollow rotary shaft and is supported by a bearing so as to be slidable forwardly and backwardly, said output shaft having a helical spline connection to a clutch inner in the overrunning clutch to obtain the transmission of a rotational force, and a pinion mounted on the front end portion of the output shaft so as to come to interlocking with the ring gear of an engine when the output shaft is forwardly moved, wherein a clutch outer in the overrunning clutch has an enlarged diameter portion for supporting a roller at its rear end side, a boss portion of a reduced diameter at its front end side, in which the outer periphery of the boss portion is supported by the front bracket by means of a bearing, and the clutch inner is supported by the inner periphery of the boss portion of the clutch outer by means of a bearing.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENT

Figure 1:
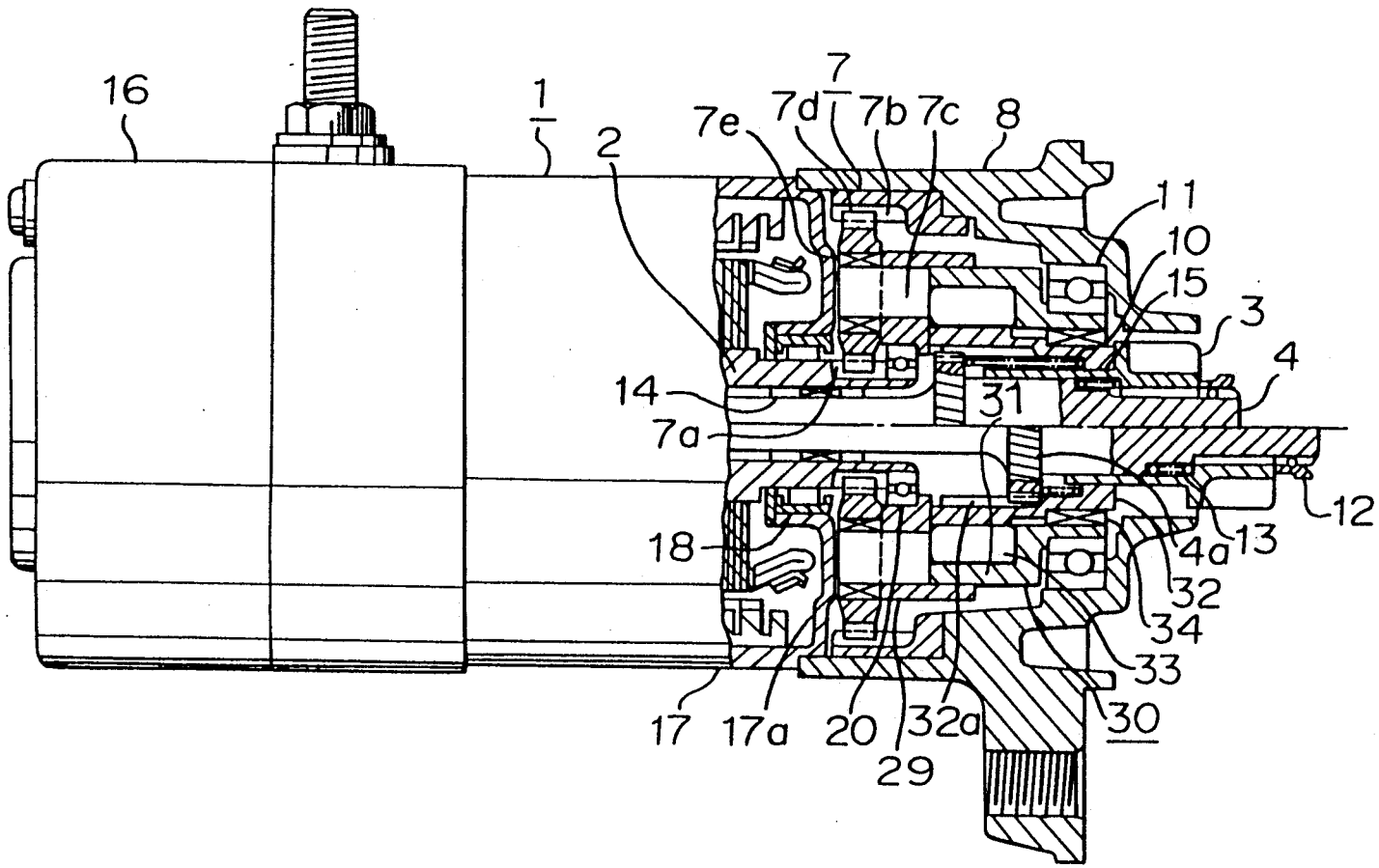
FIG. 1 is a front view partly cross-sectioned of an embodiment of the coaxial type starter motor according to the present invention.
Figure 2:
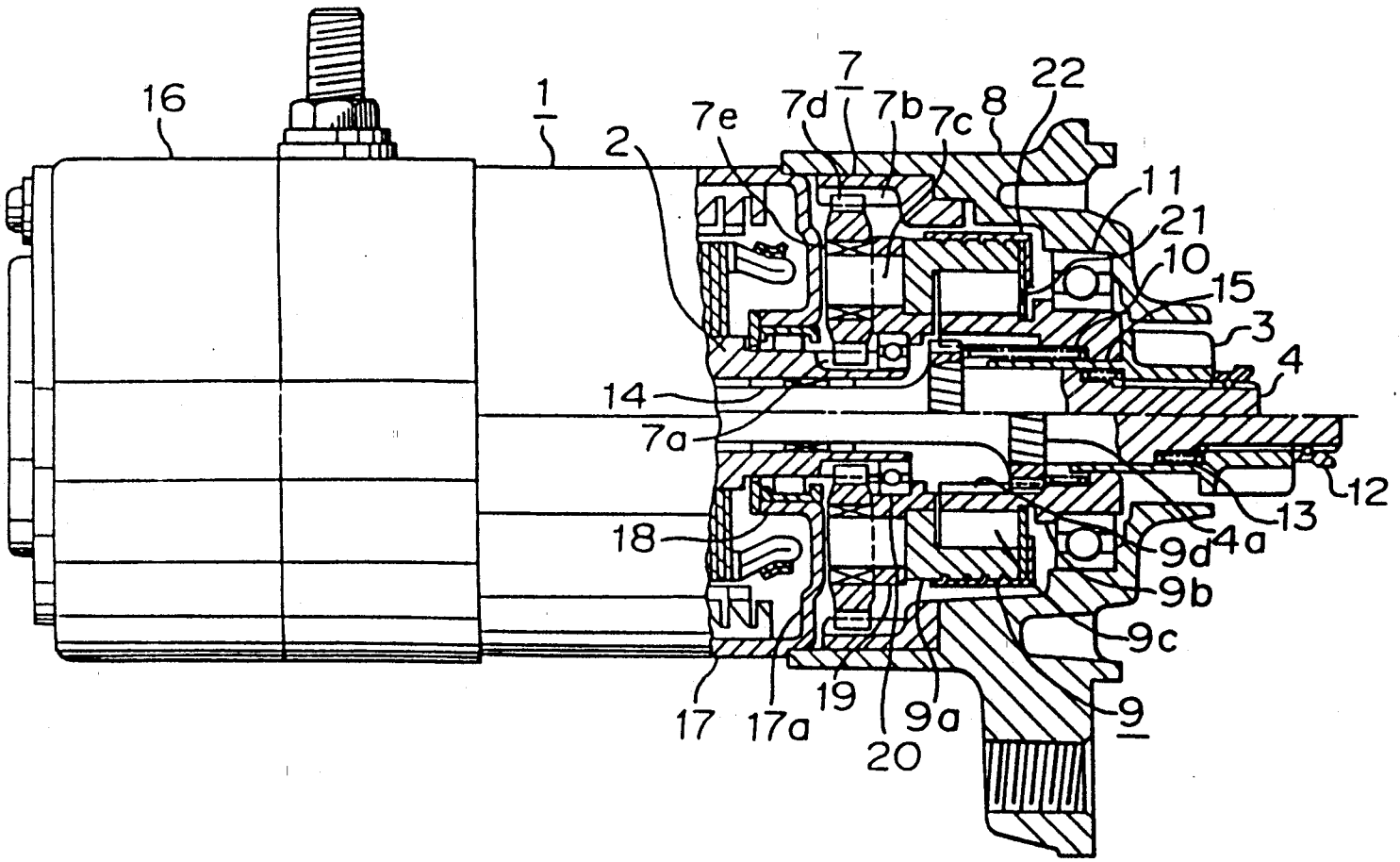
FIGURE 2 PRIOR ART
FIG. 2 is a front view partly cross-sectioned of a conventional coaxial type starter motor.

In FIG. 1 showing a front view partly cross-sectioned of an embodiment of the coaxial type starter motor of the present invention, numerals 1 to 4, 4*a*, 7, 7*a* to 7*e*, 8, 10 to 18, 17*a* and 20 designate the same element as in FIG. 2. Accordingly, description of these elements is omitted. In FIG. 1, the upper half portion of the output shaft shows a retracted returned state and the lower half portion shows an advanced state.

A carrier 29 is firmly attached with supporting pins 7*c*. The carrier 29 is supported by the rotary shaft 2 by means of the bearing 20.

An overrunning clutch 30 has a construction as follows. A clutch outer 31 has an enlarged diameter portion at its rear end and a boss portion of a reduced diameter at its front end portion. The clutch outer 31 is supported by the front bracket 8 by interposing the bearing 11. The enlarged diameter portion of the clutch outer 31 is attached to a cylindrical portion of the carrier 29. A clutch inner 32 is so arranged as to transmit a one way revolution to the clutch outer 31 by means of a roller 33 wherein the outer periphery of the front end portion of the clutch inner 32 is supported by the inner periphery of the boss portion of the clutch outer 31 by interposing a bearing 34 therebetween. A helical spline groove 32*a* is formed in the inner periphery of the clutch inner 32. The helical spline groove 32*a* is interlocked with the helical spline 4*a* of the output shaft 4 to transmit revolution. The clutch outer 31 has an opening at its rear end, which is closed by the carrier 29. Accordingly, the fitting plate 21 and the cover 22 which are needed in the conventional device can be omitted.

The clutch inner 32 is supported by the inner periphery of the both portion of the clutch outer 31 by interposing the bearing 34 therebetween so that the axial centers of the clutch inner 32 and the clutch outer 31 are in alignment. Accordingly, a possibility of causing deflection of the axial centers of the boss members can be minimized and the durability can be improved. The operation of the starter motor of the present invention is the same as that of the conventional apparatus.

Thus, in accordance with the present invention, the clutch outer of an overrunning clutch has an enlarged diameter portion at its rear side and a both portion of a reduced diameter at its front side wherein the outer periphery of the boss portion is supported by the front bracket by means of a bearing, and the outer periphery of the front end portion of the clutch inner is supported by the inner periphery of the boss portion of the clutch outer by means of a bearing. Accordingly, a possibility of deflection of the axial centers of the clutch outer and the clutch inner can be reduced and the durability is improved. Further, a fitting plate and a cover, which were used to connect the clutch outer to the clutch inner in the axial direction in a conventional apparatus, are no more necessary.

Obviously, numerous modifications and variations of the present invention are possible in light of the above teachings. It is therefore to be understood that within the scope of the appended claims, the invention may be practiced otherwise than as specifically described herein.

What is claimed is:

1. A coaxial type starter motor which comprises:

a d.c. motor comprising a hollow armature rotary shaft and a front bracket connected to a yoke, an overrunning clutch disposed in the front bracket to transmit a rotational force from the rotary shaft, an output shaft having a rear end portion which is extended into the hollow rotary shaft and is supported by a bearing so as to be slidable forwardly and backwardly, said output shaft having a helical spline connection to a clutch inner in the overrunning clutch to obtain the transmission of a rotational force, and a pinion mounted on the front end portion of the output shaft so as to come to interlocking with the ring gear of an engine when the output shaft is forwardly moved, wherein a clutch outer in the overrunning clutch has an enlarged diameter portion for supporting a roller at its rear end side, a boss portion of a reduced diameter at its front end side, in which the outer periphery of the boss portion is supported by the front bracket by means of a bearing, and the clutch inner is supported by the inner periphery of the boss portion of the clutch outer by means of a bearing.

* * * * *